US006634889B2

(12) United States Patent
Miller et al.

(10) Patent No.: US 6,634,889 B2
(45) Date of Patent: Oct. 21, 2003

(54) CROSS-CONNECTED CARD-EDGE SOCKET CONNECTOR AND CARD-EDGE

(75) Inventors: Kevin L. Miller, Austin, TX (US); Arthur Lopez, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 76 days.

(21) Appl. No.: 09/888,177

(22) Filed: Jun. 22, 2001

(65) Prior Publication Data

US 2002/0009929 A1 Jan. 24, 2002

Related U.S. Application Data

(62) Division of application No. 09/128,554, filed on Aug. 3, 1998, now abandoned.

(51) Int. Cl.[7] ..... H01R 12/00
(52) U.S. Cl. ..... 439/60; 439/637
(58) Field of Search ..... 439/188, 66, 637, 439/79, 108, 61, 62, 60, 82–83, 59, 620, 607, 608, 76.1; 361/760, 736, 752, 399, 400, 401, 410; 395/281, 275

(56) References Cited

U.S. PATENT DOCUMENTS

| | | | | | |
|---|---|---|---|---|---|
| 2,937,357 | A | * | 5/1960 | Kennedy | 439/188 |
| 4,087,151 | A | * | 5/1978 | Roberts et al. | 439/188 |
| 4,272,141 | A | * | 6/1981 | McKeen et al. | 439/61 |
| 4,871,321 | A | * | 10/1989 | Johnson | 439/79 |
| 5,017,146 | A | * | 5/1991 | Uehara et al. | 439/65 |
| 5,024,609 | A | * | 6/1991 | Piorunneck | 439/637 |
| 5,040,997 | A | * | 8/1991 | Garner | 439/77 |
| 5,276,817 | A | * | 1/1994 | Matschke et al. | 439/59 |
| 5,277,591 | A | | 1/1994 | Felcman et al. | |
| 5,339,219 | A | * | 8/1994 | Urich | 361/760 |
| 5,361,079 | A | * | 11/1994 | Yamamoto | 345/75 |
| 5,403,208 | A | | 4/1995 | Felcman et al. | |
| 5,425,651 | A | | 6/1995 | Thrush et al. | |
| 5,443,394 | A | | 8/1995 | Billman et al. | |
| 5,449,297 | A | | 9/1995 | Bellomo et al. | |
| 5,754,796 | A | * | 5/1998 | Wang et al. | 395/281 |
| 5,856,195 | A | * | 1/1999 | Charlton et al. | 436/50 |
| 5,921,784 | A | * | 7/1999 | Petersen | 439/60 |
| 5,924,899 | A | * | 7/1999 | Paagman | 439/701 |
| 6,015,299 | A | | 1/2000 | Walse et al. | 439/60 |
| 6,095,821 | A | * | 8/2000 | Panella et al. | 439/60 |

* cited by examiner

*Primary Examiner*—Jean F. Duverne
(74) *Attorney, Agent, or Firm*—Baker Botts L.L.P.

(57) ABSTRACT

A socket connector and a card-edge is provided for electrical busses. In one embodiment, a socket is provided for electrical busses that require each end of the bus to be terminated that does not require a termination card. In another embodiment, a socket connector is provided for electrical busses that flow through several aligned socket connectors. The design of the socket connector connects a bus to termination resistors located on a circuit board of the socket connector by cross-connecting the signal through the signal pins inside the socket connector.

34 Claims, 6 Drawing Sheets

CROSS-CONNECTED CARD-EDGE SOCKET CONNECTOR AND CARD-EDGE

This is a division of application Ser. No 09/128,554, filed Aug. 3, 1998 now abandoned.

BACKGROUND OF THE INVENTION

1. Field of the Invention

The present invention relates to socket connectors for circuit boards. More particularly, it relates to card-edge sockets and connectors used within computer systems.

2. Description of the Related Art

Personal computer systems in general and IBM compatible personal computer systems in particular have attained widespread use. These personal computer systems now provide computing power to many segments of modem society. A personal computer system can usually be defined as a desktop, or portable microcomputer that includes a system unit having a system processor with associated volatile and nonvolatile memory, a display monitor, a keyboard, a hard disk storage device or other type of storage media such as a floppy disk drive or a compact disk read only memory (CD ROM) drive. One of the distinguishing characteristics of these systems is the use of a system board to electrically couple these components together. These personal computer systems are information handling systems which are designed primarily to give independent computing power to a single user or group of users and are inexpensively priced. One way of keeping the cost of computer systems down is to manufacture systems that use electrical parts in an efficient manner. Given the number of electrical devices in a computer system, such efficiency is paramount.

Modern multiple processor computer systems have sockets for multiple processors or microprocessors and require a termination card instead of a processor in situations in which a consumer orders a system that does not use each socket available for a processor on the computer system.

Referring to FIG. 1*a,* a typical multi-processor circuit board 101 is represented showing two processor sockets. The first socket connector 102 holds a typical PENTIUM-type processor 107. The second socket connector 103 holds a termination card 105 with termination resistors 106. FIG. 1*b* represents a typical termination card 105 for use in the socket connector 103. Conductive pads 108 and 110 shown in FIG. 1*b* are located on the back side of the termination card, and conductive pads 109 are on the front of the card. Also shown in FIG. 1*b* are termination resistors 106 and the conductive path leading to terminal voltage 108. Referring to FIG. 1*c,* a cross-sectional view of the socket connector 103 is shown as it would appear along the axis B from FIG. 1*a.* The signal pins 111 do not electrically couple when a termination card is not present.

Like computer systems that use sockets for processors, computer systems that use sockets to hold memory require a "continuity" circuit card to be installed in any socket not used for memory. Referring to FIGS. 1*d* and 1*e,* a multiple memory module designed system 600 is represented showing three memory socket connectors 602. Each socket connector 602 holds a memory module 605. A typical memory module is a RAMBUS INLINE MEMORY MODULE (RIMM). As shown in FIG. 1*d,* the memory controller 604, also called a "memory channel", is electrically coupled to all three memory module circuit cards 605 in series, terminating through termination resistors shown as 601 leading to termination voltage 603. Thus, the memory module circuit cards 605 do not require termination resistors. FIG. 1*e* represents a typical continuity circuit card 606 and a memory module circuit card 605 for use in the socket connector 602 shown in FIG. 1*d.* The conductive pads 608 shown in FIG. 1*e* are located on side A of the continuity circuit card 606. The conductive pads 609 are located on side B (not shown) of the continuity circuit card 606. Similar to the socket connector discussed above representing a conventional connector for multi-processor systems, the socket connector that requires use of a continuity module circuit card has signal pins inside the socket connector that do not electrically couple when a continuity circuit card or a memory module is not present.

What is needed is a system that does not require the extra expense of a termination card or a continuity card.

SUMMARY OF THE INVENTION

Accordingly, the present invention provides a socket connector and a card-edge that eliminates the need for either a termination card for multiple processor systems or a continuity card for systems holding multiple sockets for memory. The design of the socket connector connects a bus, which can be a memory bus, processor bus or any electrical signal, from one side of the socket connector to the other side of the socket by cross-connecting the signal through the signal pins when the socket is empty.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

In a typical computer system, the processor is plugged into a socket on the circuit board, electrically coupling the processor bus to the processor. Similarly, memory components may be plugged into sockets on the circuit board to electrically couple a memory bus to the computer memory.

For certain computer systems, for example for PENTIUM-type computer systems, the processor bus is terminated by termination resistors at each end of the bus. The termination resistors for a multi-processor circuit board with sockets for the processors are either located on the circuit card for the processor or on a circuit card whose sole function is to provide the termination resistors for terminating the processor bus.

In a memory system such as a RAMBUS Memory Channel, either circuit cards holding additional memory components (also called "memory modules") are installed into sockets, or circuit cards (also called "continuity modules" or "continuity cards" or "shunt cards") are installed into customized sockets for providing continuity for the memory bus. The customized sockets couple the memory bus to either termination resistors or sockets electrically coupled in series to the memory bus.

The sockets designed for computer memory and the sockets designed for computer processors are located on the "mother board".

Examples of connector systems for a multi-processor system are described below with respect to FIGS. 2, 3, 4 and 5.

Figure 1A:
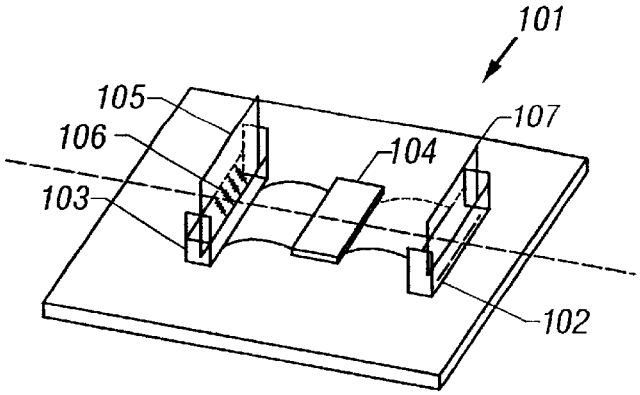
FIG. 1A (Prior Art)
FIG. 1A represents a circuit board with two socket connectors, one of which allows either a processor or a circuit card-edge with termination resistors upon the card connected directly to the card edge.
Figure 1B:
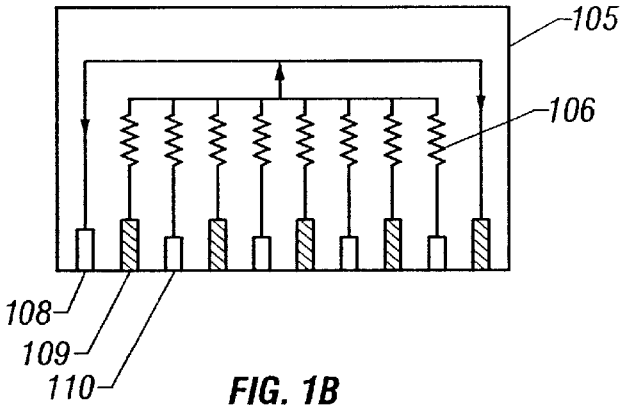
FIG. 1B (Prior Art)
FIG. 1B represents a close-up view of a termination card.
Figure 1C:
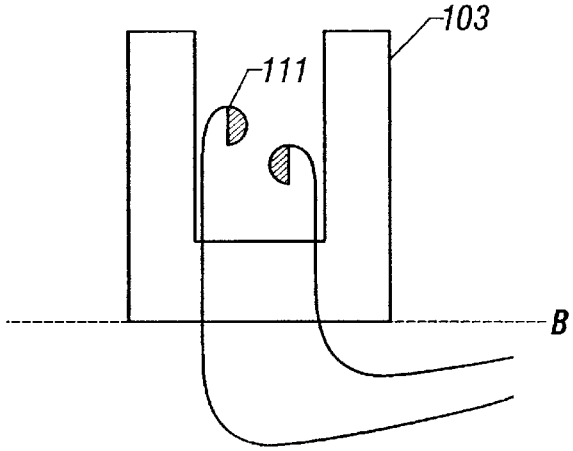
FIG. 1C (Prior Art)
FIG. 1C represents a cross-sectional view of the socket connector for use with the circuit card-edge with termination resistors.
Figure 1D:
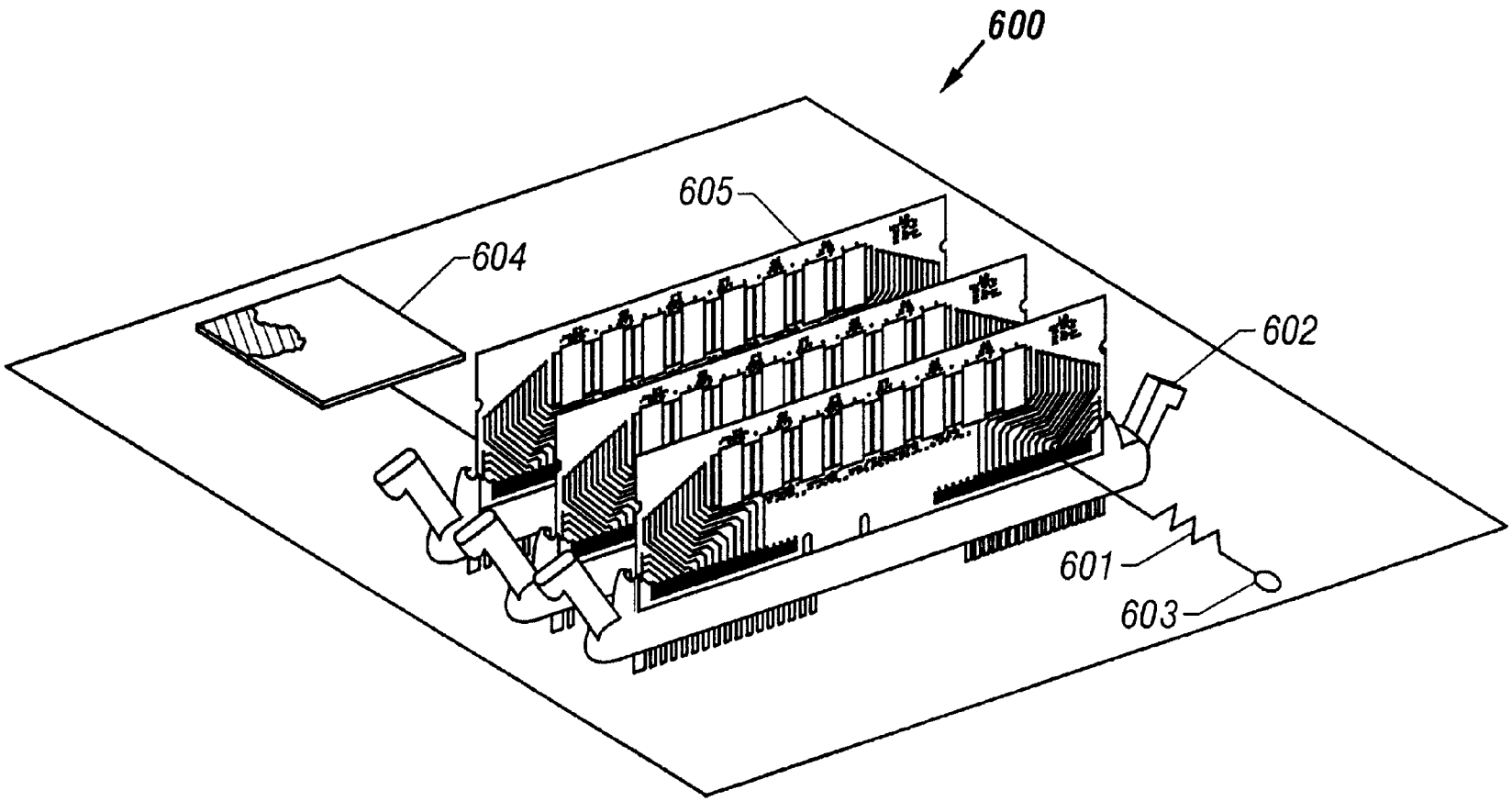
FIG. 1D (Prior Art)
FIG. 1D represents a system with three socket connectors, each of which holds a memory module circuit card that electrically couples the signals from one side of the socket connector to the other.
Figure 2:
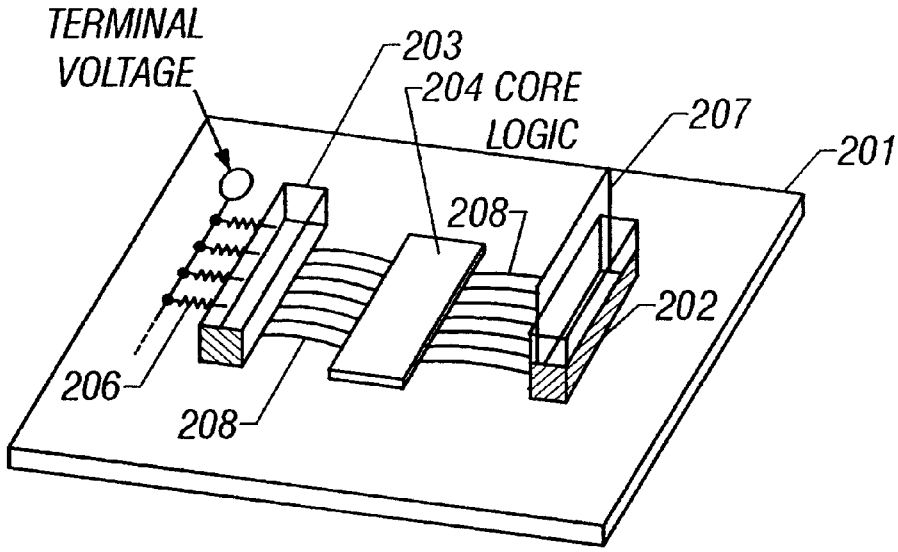
FIG. 2 represents a circuit board including an interconnect structure that avoids use of a termination card. The circuit board has two socket connectors, one of which is empty, one of which holds a processor. The termination resistors are located on the circuit board.

Referring to FIG. 2, a multi-processor circuit board 201 according to an embodiment of the present invention illustrates a first socket 202 holding a typical PENTIUM-type processor 207 and a second socket 203 standing empty or occupied by a processor. Instead of a termination card 105 with termination resistors 106 located on the card 105, as in FIG. 1*b*, the termination resistors 206 are located on the circuit board 201 itself. A processor bus 208 couples the core logic 204 and the termination resistors 206 located on the circuit board 201 through the second socket 203.

Figure 3:
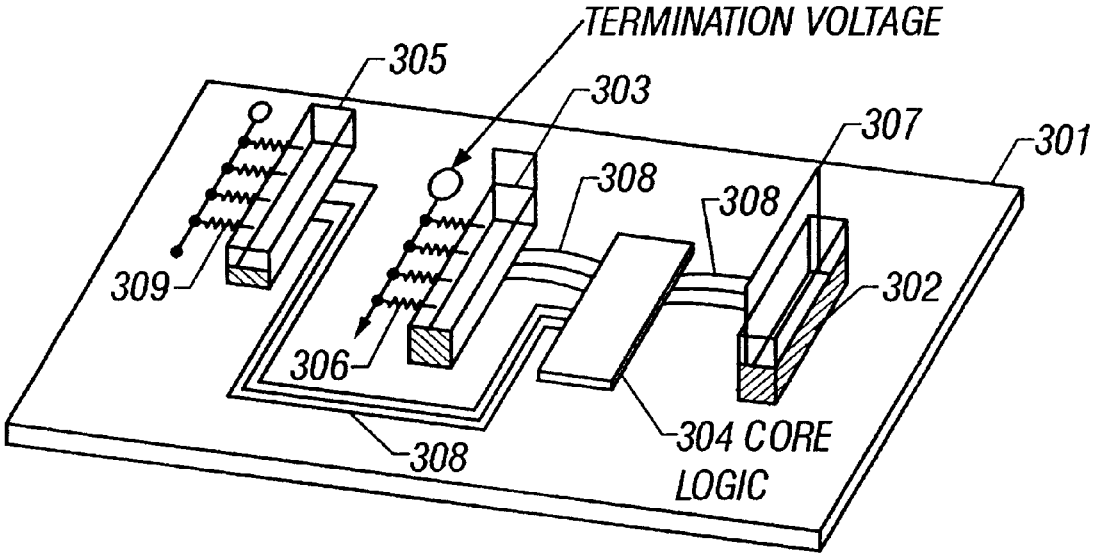
FIG. 3 represents a circuit board with three socket connectors, one of which is empty, two of which hold a processor in accordance with an embodiment of the present invention. The termination resistors are located on the circuit board.

Referring to FIG. 3, a multi-processor designed circuit board 301 that is similar to the circuit board 201 of FIG. 2 is represented. Like FIG. 2, FIG. 3 illustrates a first socket 302 holding a typical PENTIUM-type processor 307 and a second socket 303 standing empty or occupied by a processor with termination resistors 306 located on the circuit board 301 instead of on a termination card. Unlike FIG. 2, however, a third socket 305 is present. The third socket 305 holds a processor card which is electrically coupled to the processor bus 308 and to the core logic 304. The sockets 305 and 303 are independently electrically coupled to the core logic 304 through the processor bus 308. Additional sockets, each with termination resistors on the circuit board 301 could be added.

Figure 4:
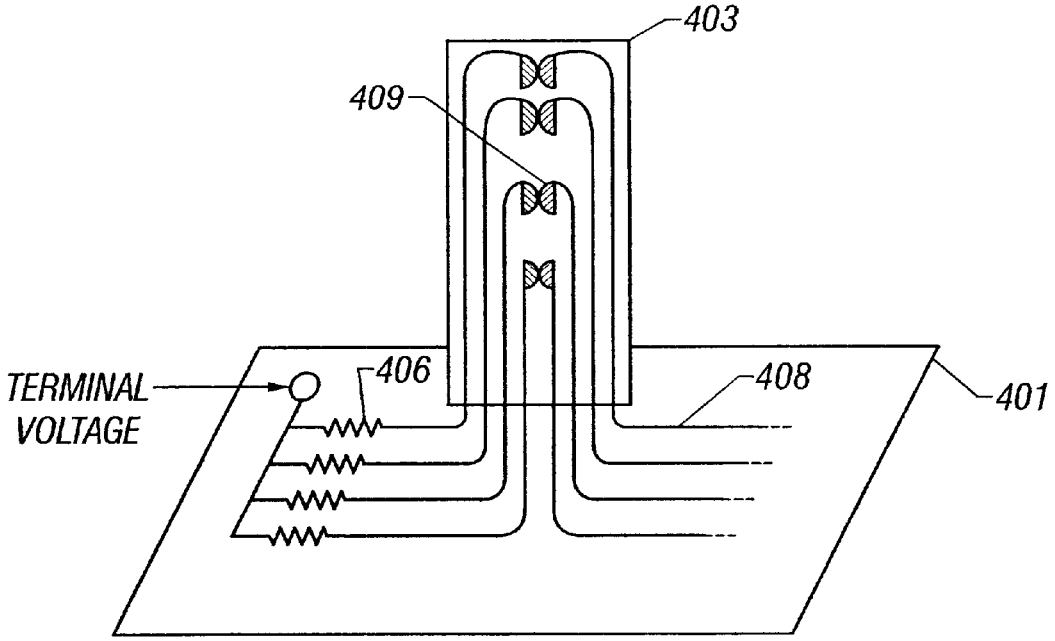
FIG. 4 represents a cross-sectional view of socket connector according to an embodiment of the present invention that is for use in a computer system.

FIG. 4 represents a cross-sectional view of a socket 403. The cross-sectional view of the socket 403 shows that the processor bus signal 408 is cross-connected through the signal pins 409 of the socket 403 so that the processor bus signal 408 reaches the termination resistors 406 located on the circuit board 401.

Figure 5:
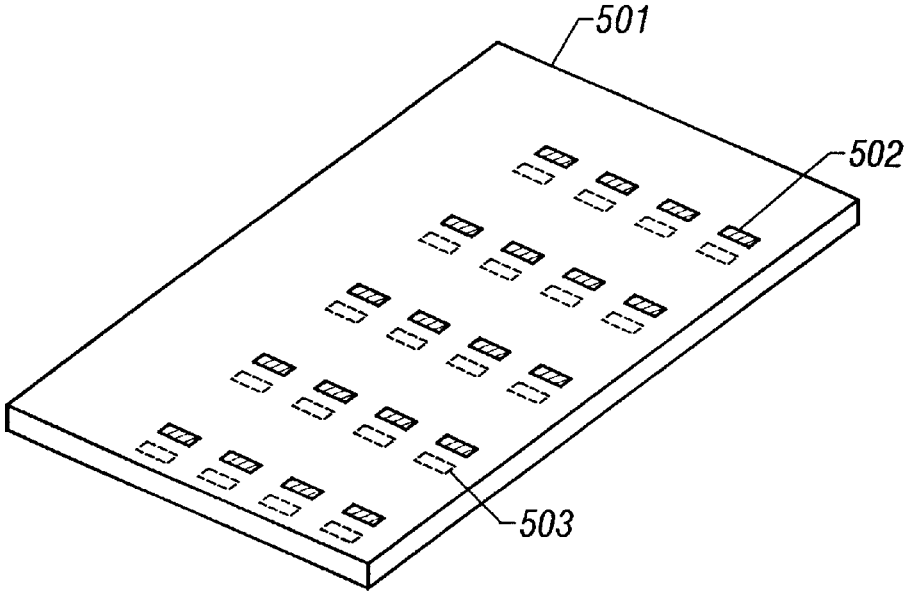
FIG. 5 represents a cross-sectional view of a card-edge according to an embodiment of the present invention suitable for use in a computer system.

Referring to FIG. 5 in combination with FIG. 4, a card-edge 501 is illustrated that conforms to the socket described above. The card-edge 501 has conductive pads 502 that connect the processor bus 408 on only one side of the card-edge 501, with null contacts 503 on the opposite side of the card-edge 501. Upon insertion of the card-edge 501, the conductive pads 502 connect the processor bus 408, shown in FIG. 4, to the circuit card-edge 501, thereupon disconnecting the electrical coupling between the signal pin pairs 409.

Figure 6:
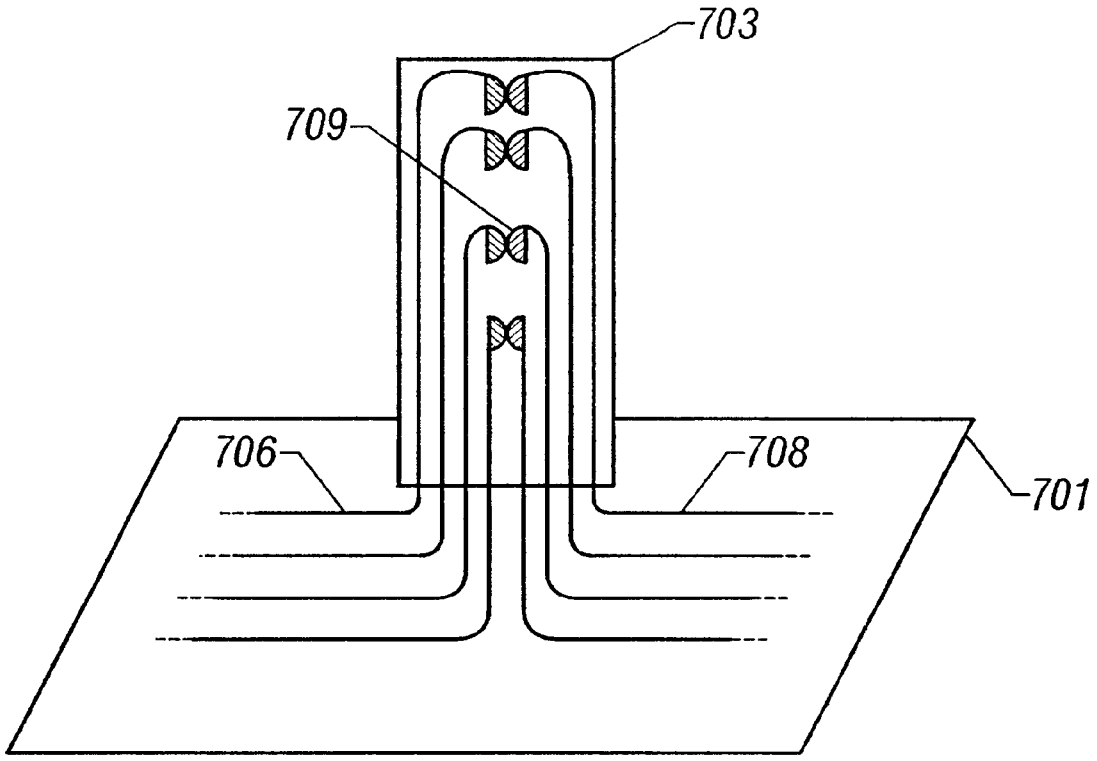
FIG. 6 represents a cross-sectional view of a socket connector in accordance with an embodiment of the present invention.

Referring to FIG. 6, a socket in accordance with an embodiment of the present invention is represented. The socket 703 is designed with signal pins 709 that are paired to electrically couple when a memory module circuit card is not present, thereby making the continuity circuit card unnecessary. The socket 703 connects the memory bus signals 708 from one side of the socket 703 to the other side of the socket in order to electrically couple the memory bus 708. Unlike the connector system described above with respect to FIG. 4, for the multiple memory socket system, termination resistors are not required for each socket because the sockets are electrically coupled to one another.

Figure 1E:
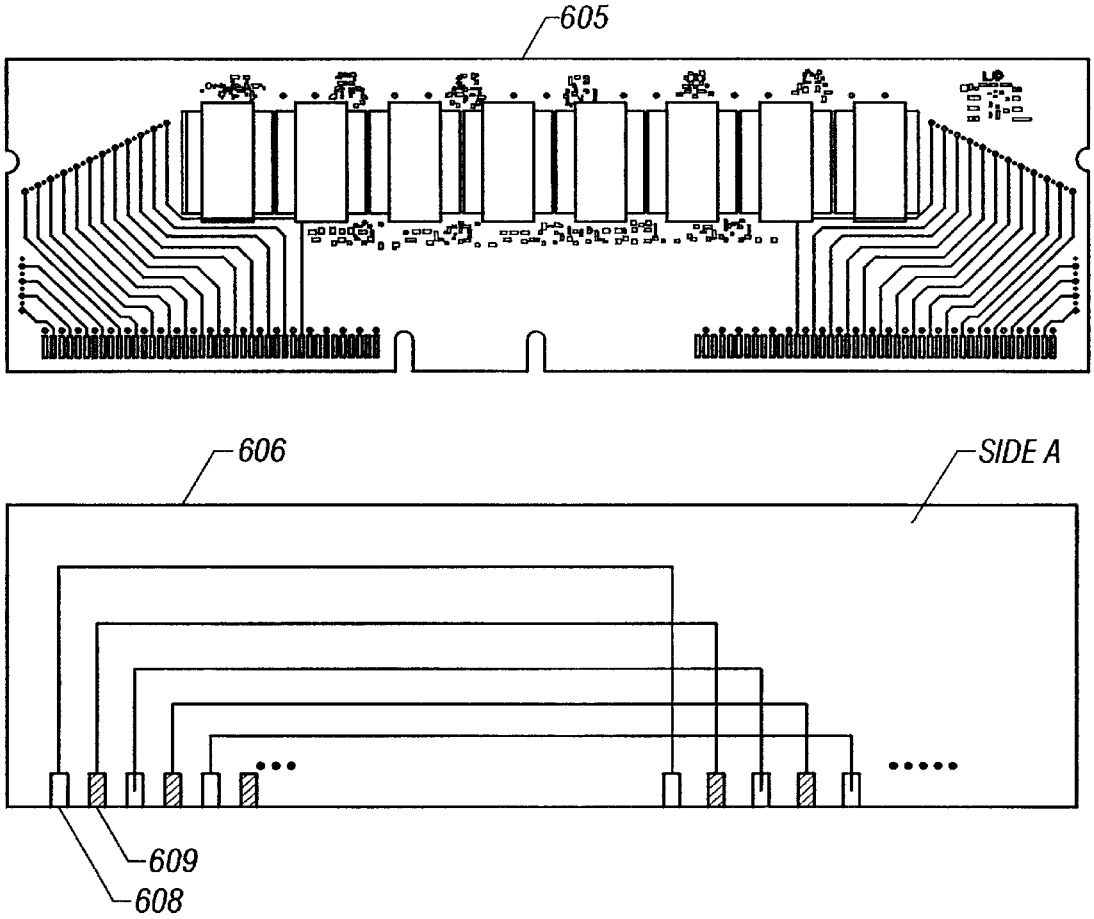
FIG. 1E (Prior Art)
FIG. 1E represents a close-up view of a continuity card.

The memory module circuit card 606 pictured in FIG. 1*e* is incompatible with socket 703. Rather, a memory module circuit card with a card-edge similar to that pictured in FIG. 5 is suitable. Instead of null contacts, such as null contacts 503, on one side of the card-edge, however, the card-edge uses contacts on both sides, such as conductive pads 502, 50 that the memory bus is passed in to and out of the memory card upon installation of a card-edge.

The above description is intended to be illustrative of the invention and should taken to be limiting. Other embodiments are possible. For example, the bus can be replaced by any electrical signal.

What is claimed is:

1. An apparatus comprising:

a circuit board;

a plurality of termination resistors mounted on the circuit board; and a socket connector mounted on the circuit board, the socket connector being electrically coupled to the termination resistors, the socket connector having:

a card-edge receiving area to receive a card-edge of a circuit card; and a plurality of opposing signal pins within the card-edge receiving area, at least some of the plurality of opposing signal pins being coupled to respective termination resistors of the plurality of termination resistors, and the opposing signal pins being in contact with each other when no card-edge is present in the card-edge receiving area, and the opposing signal pins being separated from each other when the card-edge is present in the card-edge receiving area such that the electrical coupling of the termination resistors and the socket connector is disconnected when the card-edge is inserted.

2. The apparatus of claim 1 wherein the card-edge includes a plurality of signal contacts such that each signal pin of the plurality of signal pins contacts one signal contact of the signal contacts when the card edge is inserted in the card edge receiving area, each signal contact of the signal contacts being one of a conductive pad and a null contact.

3. The apparatus of claim 1 wherein the circuit card includes memory.

4. The apparatus of claim 1 wherein the circuit card includes a processor.

5. The apparatus of claim 1 wherein the card-edge is adapted for the card-edge receiving area, wherein the card-edge has one of:

conductive pads on a first side and null contacts on an opposing side;

conductive pads and null contacts on the first side and conductive pads on the opposing side; and conductive pads on the first side and conductive pads on the opposing side.

6. The apparatus of claim 1 wherein the circuit card has a first side and an opposing side, each of the first side and the opposing side having a corresponding conductive surface; and the circuit card electrically couples the conductive surface of each of the first side and the opposing side to a circuit board signal of the circuit board through the opposing signal pins when the circuit card-edge is inserted into the card-edge receiving area.

7. The apparatus of claim 1, wherein the plurality of opposing signal pins includes:

a first plurality of adjacent pairs of opposing signal pins aligned in at least a first dimension; and a second plurality of adjacent pairs of opposing signal pins aligned with the first plurality in at least a second dimension, the second dimension being perpendicular relative to the first dimension.

8. The apparatus of claim 7 wherein the circuit card when inserted into the receiving area physically separates the opposing signal pins of each adjacent pair of the first plurality from each other and physically separates the opposing signal pins of each adjacent pair of the second plurality from each other.

9. The apparatus of claim 1 further comprising:

a bus that is electrically coupled to the opposing signal pins of the socket connector.

10. The apparatus of claim 9 wherein a bus signal of the bus is connected via the opposing signal pins such that a bus signal of the bus reaches the termination resistors when no card-edge is present.

11. The apparatus of claim 9 wherein the insertion of the card-edge into the card-edge receiving area adds additional circuitry to the bus while maintaining continuity of the bus.

12. The apparatus of claim 9 wherein the insertion of the card-edge into the socket connector electrically couples a bus signal of the bus to the circuit card.

13. The apparatus of claim 12 wherein the insertion of the card-edge into the socket connector electrically disconnects the bus signal from the termination resistors.

14. The apparatus of claim 1 wherein the socket connector is a first socket connector of a plurality of socket connectors, wherein each socket connector of the socket connectors is mounted on the circuit board; and at least one of the socket connectors is electrically coupled to the termination resistors;

and further comprising:

a plurality of signal lines electrically coupling the first socket connector in series to at least a second socket connector of the socket connectors, each signal line of the signal lines being electrically coupled to the first and second socket connectors when no card-edge is present.

15. The apparatus of claim 14 wherein the plurality of signal lines is a memory bus.

16. The apparatus of claim 14 wherein the plurality of signal lines is a processor bus.

17. The apparatus of claim 1 wherein the socket connector is a first socket connector of a plurality of socket connectors;

the first socket connector holds a processor; and each socket connector of the socket connectors is electrically coupled to a processor bus signal of a processor bus for the processor.

18. A computer system comprising:

at least a first processor;

a memory coupled to the first processor;

a circuit board coupled to the at least a first processor and the memory;

a plurality of termination resistors mounted on the circuit board; and a socket connector mounted on the circuit board, the socket connector being electrically coupled to the termination resistors, the socket connector having:

a card-edge receiving area to receive a card-edge of a circuit card; and a plurality of opposing signal pins within the card-edge receiving area, at least some of the plurality of opposing signal pins being coupled to respective termination resistors of the plurality of termination resistors, and the opposing signal pins being in contact with each other when no card-edge is present in the card-edge receiving area, and the opposing signal pins being separated from each other when the card-edge is present in the card-edge receiving area such that the electrical coupling of the termination resistors and the socket connector is disconnected when the card-edge is inserted.

19. The computer system of claim 18 wherein the card-edge includes a plurality of signal contacts such that each signal pin of the plurality of signal pins contacts one signal contact of the signal contacts when the card edge is inserted in the card edge receiving area, each signal contact of the signal contacts being one of a conductive pad and a null contact.

20. The computer system of claim 18 wherein the circuit card includes the memory.

21. The computer system of claim 18 wherein the circuit card includes the first processor.

22. The computer system of claim 18 wherein the card-edge is adapted for the card-edge receiving area, wherein the card-edge has one of:

conductive pads on a first side and null contacts on an opposing side;

conductive pads and null contacts on the first side and conductive pads on the opposing side; and conductive pads on the first side and conductive pads on the opposing side.

23. The computer system of claim 18 wherein the circuit card has a first side and an opposing side, each of the first side and the opposing side having a corresponding conductive surface; and the circuit card electrically couples the conductive surface of each of the first side and the opposing side to a circuit board signal of the circuit board through the opposing signal pins when the circuit card-edge is inserted into the card-edge receiving area.

24. The computer system of claim 18 wherein the plurality of opposing signal pins includes:

a first plurality of adjacent pairs of opposing signal pins aligned in at least a first dimension; and a second plurality of adjacent pairs of opposing signal pins aligned with the first plurality in at least a second dimension, the second dimension being perpendicular relative to the first dimension.

25. The computer system of claim 24 wherein the circuit card when inserted into the receiving area physically separates the opposing signal pins of each adjacent pair of the first plurality from each other and physically separates the opposing signal pins of each adjacent pair of the second plurality from each other.

26. The computer system of claim 18 further comprising:

a bus that is electrically coupled to the opposing signal pins of the socket connector.

27. The computer system of claim 26 wherein a bus signal of the bus is connected via the opposing signal pins such that a bus signal of the bus reaches the termination resistors when no card-edge is present.

28. The computer system of claim 26 wherein the insertion of the card-edge into the card-edge receiving area adds additional circuitry to the bus while maintaining continuity of the bus.

29. The computer system of claim 26 wherein the insertion of the card-edge into the socket connector electrically couples a bus signal of the bus to the circuit card.

30. The computer system of claim 29 wherein the insertion of the card-edge into the socket connector electrically disconnects the bus signal from the termination resistors.

31. The computer system of claim 18 wherein the socket connector is a first socket connector of a plurality of socket connectors, wherein each socket connector of the socket connectors is mounted on the circuit board; and at least one of the socket connectors is electrically coupled to the termination resistors;

and further comprising:

a plurality of signal lines electrically coupling the first socket connector in series to at least a second socket connector of the socket connectors, each signal line of the signal lines being electrically coupled to the first and second socket connectors when no card-edge is present.

32. The computer system of claim 31 wherein the plurality of signal lines is a memory bus.

33. The computer system of claim 31 wherein the plurality of signal lines is a processor bus.

34. The computer system of claim 18 wherein the socket connector is a first socket connector of a plurality of socket connectors;

the first socket connector holds a processor; and each socket connector of the socket connectors is electrically coupled to a processor bus signal of a processor bus for the processor.

* * * * *